US006117602A

United States Patent [19]

Liu et al.

[11] Patent Number: 6,117,602

[45] Date of Patent: Sep. 12, 2000

[54] ELECTROSTATIC PRINTING METHOD AND APPARATUS HAVING ENHANCED IMAGE RESOLUTION CHARACTERISTICS

[75] Inventors: Chu-heng Liu, Penfield; Weizhong Zhao, Webster, both of N.Y.

[73] Assignee: Xerox Corporation, Stamford, Conn.

[21] Appl. No.: 09/232,460

[22] Filed: Jan. 19, 1999

[51] Int. Cl.[7] ..... G03G 13/01; G03G 15/01

[52] U.S. Cl. ..... 430/42; 399/232

[58] Field of Search ..... 430/42, 106, 122; 399/51, 232

[56] References Cited

U.S. PATENT DOCUMENTS

| | | | |
|---|---|---|---|
| 4,078,929 | 3/1978 | Gundlach | 96/1.2 |
| 4,267,556 | 5/1981 | Fotland et al. | 346/165 |
| 4,885,220 | 12/1989 | Kuhman et al. | 430/31 |
| 5,619,313 | 4/1997 | Domoto et al. | 399/233 |
| 5,696,396 | 12/1997 | Landa et al. | 399/237 |
| 5,781,828 | 7/1998 | Caruthers, Jr. et al. | 399/57 |
| 5,983,045 | 11/1999 | Suzuki et al. | 399/51 |
| 5,985,499 | 11/1999 | Guth et al. | 430/42 |

*Primary Examiner*—John Goodrow

[57] ABSTRACT

A method and apparatus for enhancing image resolution characteristics of an electrostatographic printing device use toners of opposite polarity to generate a toner image.

24 Claims, 8 Drawing Sheets

FIG. 10
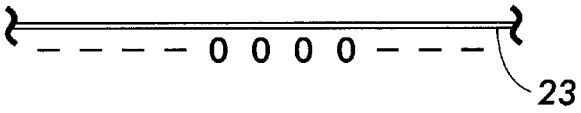
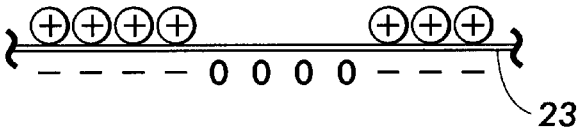
FIG. 11
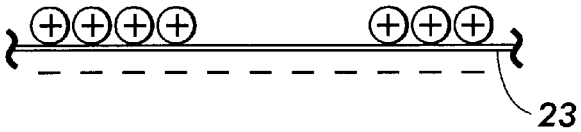
FIG. 12
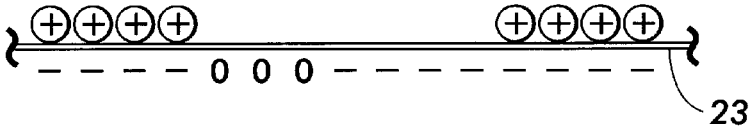
FIG. 13
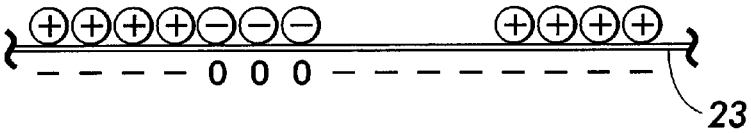
FIG. 14

ELECTROSTATIC PRINTING METHOD AND APPARATUS HAVING ENHANCED IMAGE RESOLUTION CHARACTERISTICS

BACKGROUND OF THE INVENTION

1. Field of Invention

This invention generally relates to electrostatic printing apparatus and methods of electrostatic printing. In particular, the invention relates to methods and apparatus for enhancing the image resolution characteristics of an electrostatic printing apparatus, especially when performing image-next to-image (INI) printing processes.

2. Description of Related Art

Electrostatographic printing is well known and commonly used for copying or printing documents on a paper substrate. Electrostatographic printing is performed by forming a substantially uniform charge on a photoconductive member and exposing the photoconductive member to a pattern of light. Exposing the photoconductive member to the pattern of light generates a corresponding electrostatic latent image on the photoconductive member. Toner particles are then deposited onto the photoconductive member so that the toner particles are selectively deposited in either charged or discharged areas on the photoconductive member. The developed toner image is then typically transferred to a substrate and fixed to the substrate by heat and/or pressure. The photoreceptor is then cleaned of any residual toner or electric charge in preparation for another charge/electrostatic latent image generating/development process.

For the purposes of the present description, the concept for latent image development via direct surface-to-surface transfer of a toner layer via image-wise forces will be identified generally as Contact Electrostatic Printing (CEP). As one variant of CEP, a thin layer of liquid developer is brought into contact with an electrostatic latent image on another surface, wherein development of the latent image occurs upon separation of the first and second surfaces, as a function of the electric field strength generated by the latent image. In this process, toner particle migration or electrophoresis is replaced by direct surface-to-surface transfer of a toner layer induced by image-wise fields.

Patents which may describe certain general aspects of CEP, as well as specific apparatus therefor, may be found in U.S. Pat. Nos. 5,436,706 and 5,596,396, issued to Landa et al., U.S. Pat. No. 5,619,313, issued to Domoto et al., as well as other patents cited therein.

Electrostatographic printing systems that perform image-next to-image (INI) printing processes are known. In an INI process, also known as highlight or spot color processes, toner layers are arranged side-by-side to achieve a desired image. For example, a highlight electrostatographic printing apparatus can form an image having a blue (the highlight color) square positioned next to a black square by forming two toner layers of black and blue toner next to each other.

However, image quality problems exist with the known printing systems when two images of different colors are developed onto a single image bearing member. In the known systems, the two different toners are typically deposited at two different times, often separated by a photoreceptor recharge and electrostatic latent image generation process. If the toner constituting the first image is still active (charged and can move under an electric field) when going through the development step of the second color, the toner can be removed from the image bearing member by the electrostatic field corresponding to the second latent image.

In particular, the toner of the first image in the background area of the second image will be removed and give rise to the difficulties of producing two color images next to each other. Thus, the first layer of toner deposited on the photoreceptor is often attracted to and displaced when the second electrostatic latent image is formed on the photoreceptor and developed.

For example, FIG. 1 shows an intended toner image to be formed on a photoreceptor 1. In FIG. 2, a first development process is performed using first toner particles 2. In this example, charged area development (CAD) is performed with positive polarity first toner 2. In CAD, the discharged areas 3 of the photoreceptor (denoted by "o") have substantially no charge or have little charge so that the first toner particles 2 are not attracted to the discharged areas 3.

FIG. 3 shows the photoreceptor during second development using second toner particles 4. The second toner particles 4 are shown as squares in FIG. 3 to more clearly indicate the different toner particles. However, the second toner particles 4 do not necessarily have a square shape. In some cases, the first toner particles 2 are attracted away from the photoreceptor 1 due to charge on the toner support 5 or other electrostatic forces. FIG. 4 shows the photoreceptor 1 after the second development process using second toner particles 4 is complete.

SUMMARY OF THE INVENTION

The invention provides an image forming method and system having an enhanced image resolution characteristic, especially when performing an image-next to-image (INI) process.

The invention provides an image forming system that uses different polarity toner to generate an image. Using opposite polarity toner reduces the likelihood that a first developed toner image is disturbed during subsequent development processes.

In one aspect of the invention, a common charge director is used to charge both polarity types of toner.

In one aspect of the invention, the two toners charge each other without use of a charge director.

In one aspect of the invention, neutral or very low charged toner is charged using a corona-type charging device.

The invention also provides a method for enhancing image resolution. According to the method, a first electrostatic latent image is developed using toner of a first polarity. A second electrostatic latent image is developed using toner of a second polarity different from the first polarity. As a result, a toner image is generated that includes toner of two different polarities.

In one aspect of the invention, an electrostatic latent image (or a number or images) is developed using toner(s) of a first polarity, and a subsequent image is developed in the background area of the previous image(s) using toner of an opposite polarity.

In one aspect of the invention, an electrostatic latent image (or a number of images) is developed using toner(s) of a first polarity, and a subsequent image is developed using an opposite polarity toner resulting in no overlap of the image of different charge polarity.

In one aspect of the invention, a multilevel latent image is developed using different polarity toner.

BRIEF DESCRIPTION OF THE DRAWINGS

The invention will be described in relation to the following drawings in which reference numerals refer to like elements, and wherein:

FIGS. 10–14 show five stages of an example image generation operation performed by the FIG. 9 printing apparatus;

DETAILED DESCRIPTION OF PREFERRED EMBODIMENTS

The invention is described below as used in a printing apparatus that performs a contact electrostatic printing (CEP) process. However, the invention can be used in other processes, such as conventional liquid xerography and/or powder xerography processes.

CEP is similar to conventional liquid and powder xerography, but has several substantial differences from these conventional systems. Some of the hallmarks of a CEP system include:

(a) a liquid toner medium that has a relatively high solid content (approximately 10–50% solids), which is 5 to 25 times higher than the liquid developing medium typically used in liquid xerography;

(b) developing an electrostatic latent image on an image support using supply limited development techniques, i.e., the developing potential of the latent image is not typically exhausted after being initially developed; and (c) limited relative movement between toner particles during and after latent image development, i.e., the relatively high solid content of the toner prevents toner particles from moving relative to each other, unlike that in other liquid developing mediums, and the liquid carrier in the toner serves to bind the toner particles together as a single mass, unlike the individual toner particles in powder developing systems.

Figure 1:
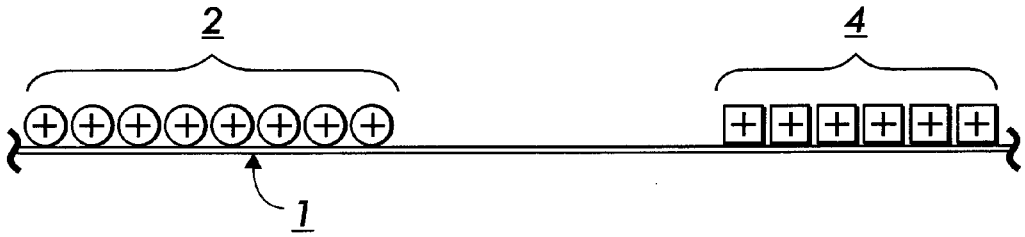
FIGS. 1–4 show different stages in a conventional INI development process.
Figure 2:
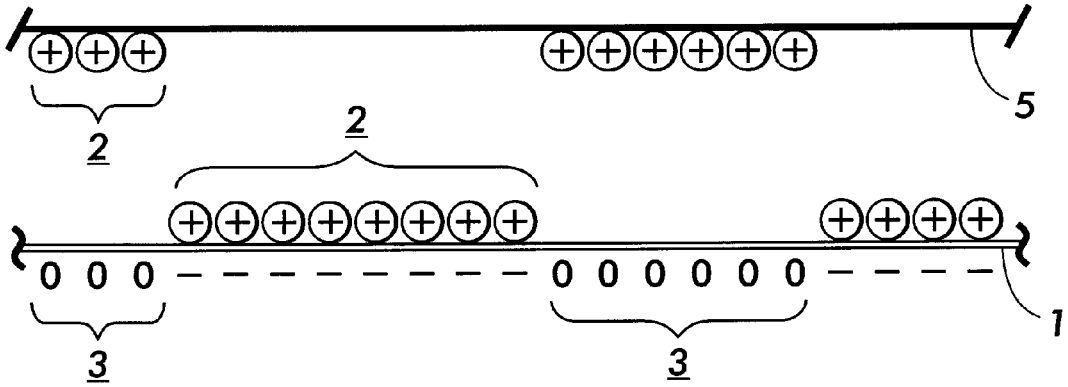
Figure 3:
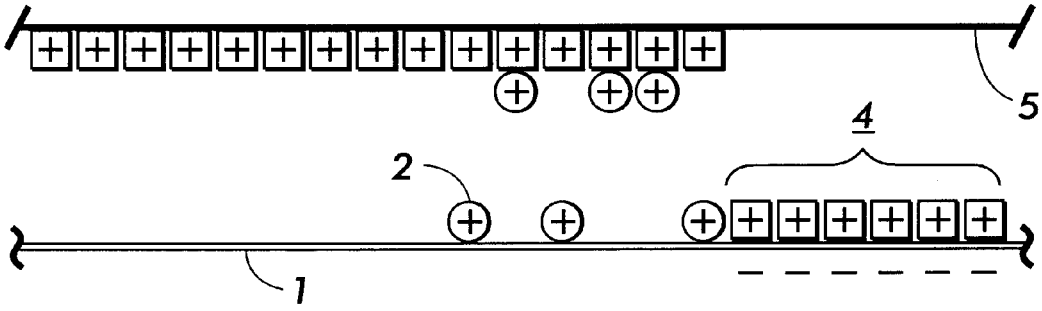
Figure 4:
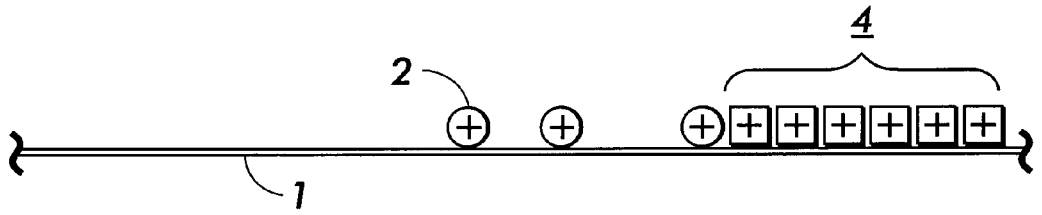
Figure 5:
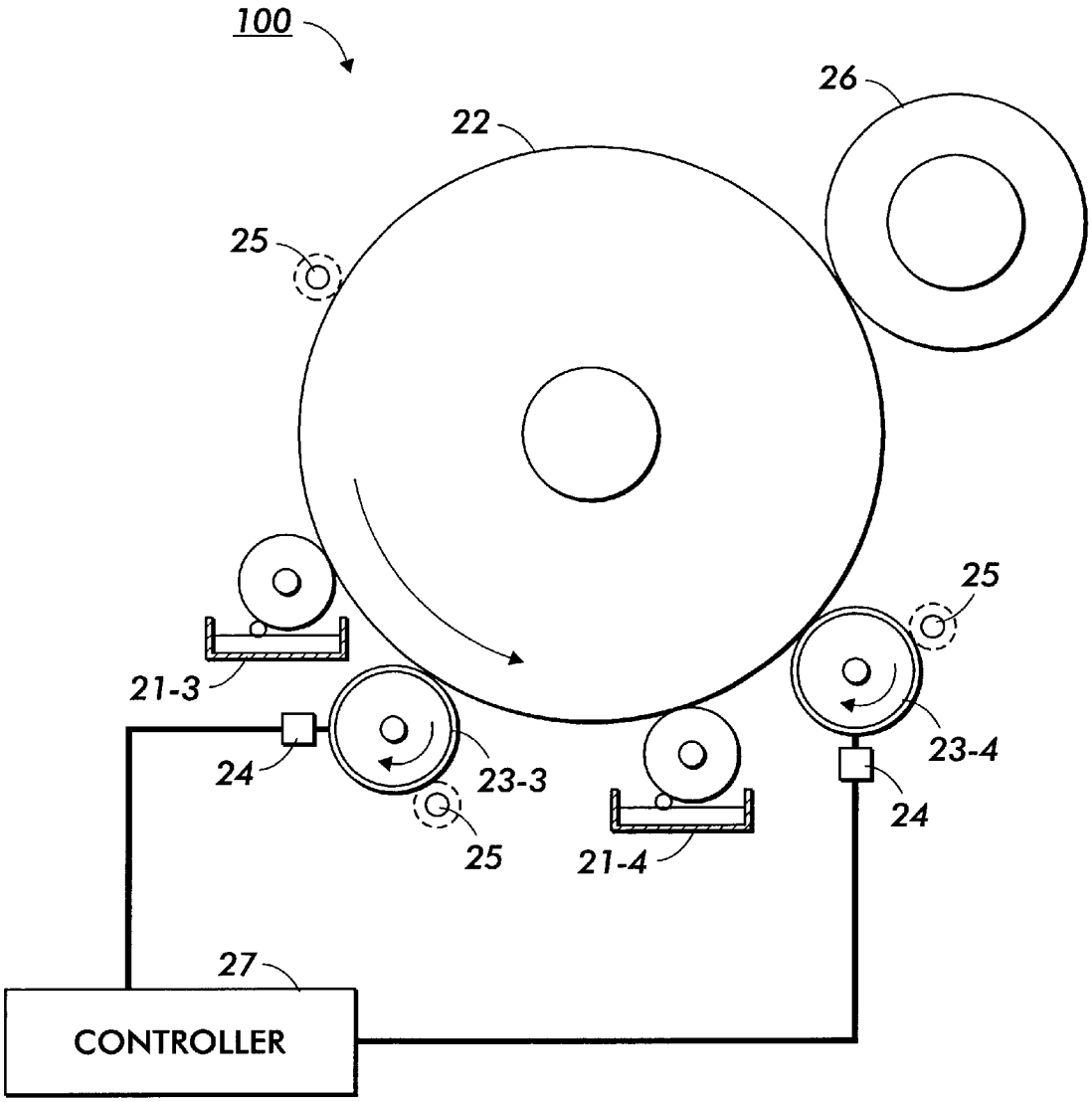
FIG. 5 is a first embodiment of a printing apparatus in accordance with the invention.

FIG. 5 is a schematic diagram of a first embodiment of a printing apparatus in accordance with the invention. The printing apparatus can be a copier, printer or other image forming system. Two toner applicators 21-3 and 21-4 each apply a layer of toner on an outer surface of an image roll 22. Preferably, the toner applicators 21 are controllable to deposit patches of varying size, shape, density and location on the image roll 22, as described in U.S. Pat. No. 6,009,294. Although the apparatus 100 shown in FIG. 5 includes two toner applicators 21, more toner applicators 21 can be used. In addition, the toner applicators 21 need not be controllable to deposit discrete patches of toner on the image roll 22. Rather, the toner applicators 21 can deposit continuous layers of toner.

The toner applicators 21-3 and 21-4 preferably apply different color toners to the image roll 22. For example, toner applicator 21-3 can apply a black toner and toner applicator 21-4 can apply a red toner. As is understood by those of ordinary skill in the art, a variety of other colors can be used.

Electrostatic charge patterns are generated on the photoreceptors 23-3 and 23-4 by electrostatic charge pattern generators 24 that preferably include a charging device, such as a corotron, scorotron or roller that charges a photosensitive surface of the photoreceptors 23-3 and 23-4 to a desired voltage level. The electrostatic charge pattern generators 24 also preferably include a light source, such as a laser, that illuminates selected portions of the charged surface of the photoreceptors 23-3 and 23-4 to discharge the selected portions. The resulting charge pattern corresponds to or otherwise represents a desired image, such as an image scanned from a paper document or created using another imaging or image generating device, such as a camera or computer paint or draw application.

As the image roll 22 rotates as shown in FIG. 5, an electrostatic charge pattern on the photoreceptors 23-3 and 23-4 operates to selectively remove portions of the toner applied to the image roll 22 by the toner applicators 21-3 and 21-4. Other toner portions left on the image roll 22 represent a developed toner image that is preferably transferred to a final surface, such as a paper substrate, by a transfixing device 26. The transfixing device 26 transfers the toner image on the image roll 22 to the final surface using any one of known techniques, including pressure, heat and/or an electrical charge differential. Residual toner left on the image roll 22 or the photoreceptor 23 is removed by cleaning devices 25. The cleaning devices can include a scraping blade and/or a sponge roller and/or other known devices for removing residual toner and any remaining electrical charge on the image roll 22 and/or the photoreceptor 23.

Preferably, a common charge director for charging the opposite polarity toners is used. However, separate charge directors are possible. It is also possible that the two opposite polarity toners charge each other without using a charge director. Optionally, very lowly charged toner can be used or a neutral toner that is charge with a corona-type device can be used.

The FIG. 5 apparatus 100 is preferably controlled by a controller 27. The controller 27 is shown in FIG. 5 as only communicating with and controlling the electrostatic charge pattern generators 24, but the controller 27 can control other elements of the apparatus 100, as desired. The controller 27 preferably includes a general purpose computer that is programmed and has appropriate circuitry to supply the appropriate control signals to the control elements of the apparatus 100. The controller 27 can also be implemented, at least in part, as a single special purpose integrated circuit (e.g., ASIC) or an array of ASICs, each having a main or central processor section for overall, system-level control, and separate sections dedicated to performing various different specific computations, functions and other processes under the control of the central processor section. The controller 27 can also be implemented using a plurality of separate dedicated programmable integrated or other electronic circuits or devices, e.g., hardwired electronic or logic circuits such as discrete element circuits or programmable logic devices. The controller 27 also preferably includes other devices, such as volatile or non-volatile memory devices, communications devices, relays, motors, mechanical linkages, and/or other circuitry or components necessary to perform the desired input/output or other functions.

Figure 6:
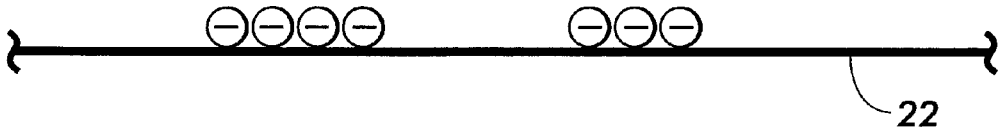
FIGS. 6–8 show three stages of an example image generation operation performed by the FIG. 5 printing apparatus.
Figure 7:
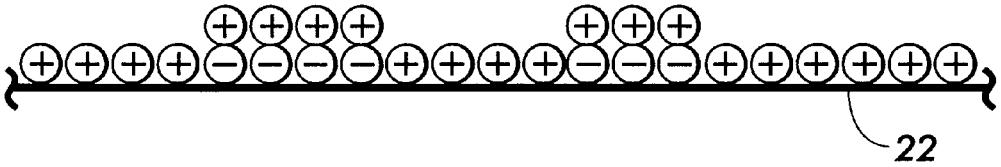
Figure 8:
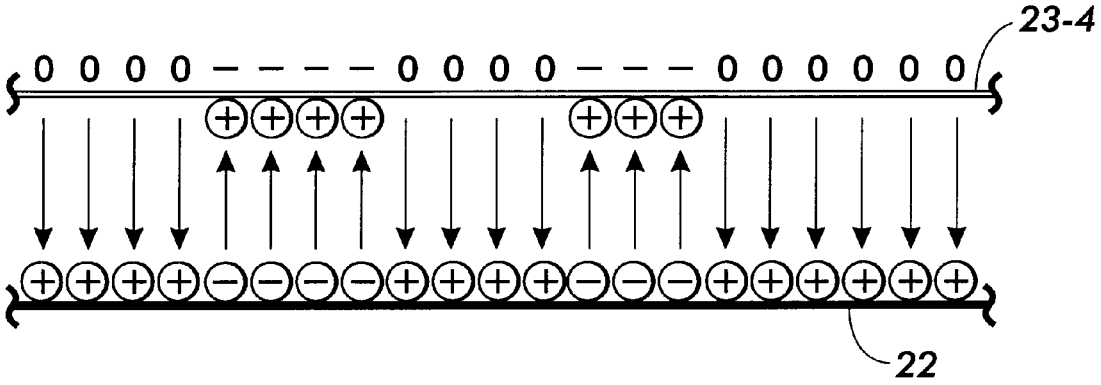

FIGS. 6–8 show three stages of generating a toner image using the FIG. 5 apparatus. FIG. 6 shows a portion of the image roll 22 after a first toner image of negative polarity toner particles has been developed on the photoreceptor 23-3, e.g., using a CEP process. FIG. 7 shows the image roll 22 portion after the toner applicator 21-4 has applied a layer of positive polarity toner particles on the image roll 22. In FIG. 8, the photoreceptor 23-4, which carries an electrostatic latent image, acts on the toner on the image roll 22. Negatively charged areas of the photoreceptor 23-4 attract positive toner particles, but repel negative toner particles. Uncharged areas of the photoreceptor 23-4 have no or little affect on deposited toner particles. Since the negatively charged areas of the photoreceptor 23-4 repel negative toner particles, the first toner image is actually kept in place rather than disturbed by the latent image on the photoreceptor 23-4. Positive polarity toner could be deposited first, followed by negative polarity toner, if desired. Likewise, a positive charging photoreceptor can be used rather than a negatively charging photoreceptor.

Figure 9:
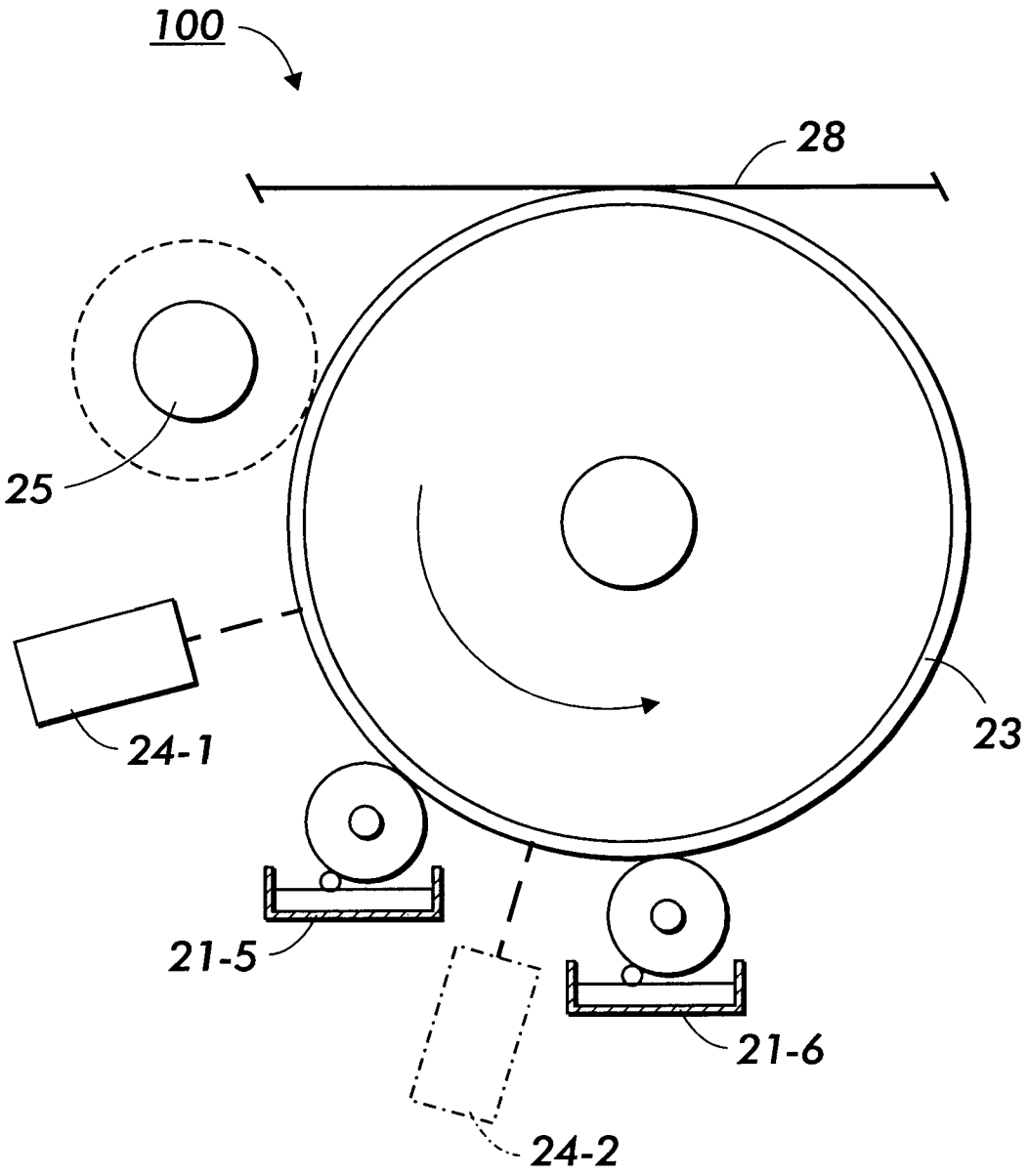
FIG. 9 is a second embodiment of a printing apparatus in accordance with the invention.

In the FIG. 5 apparatus 100, there preferably is no image conditioning between each toner image generation. That is, there is no device or other processing to stabilize the developed image, including removing fluid from a deposited toner patch before another toner patch is applied to the image roll 22 either next to or on top of the first deposited toner image. However, such image conditioning can be performed if desired to avoid any color contamination or ink poisoning problems that occur or may occur when toners mix or are near each other. Image conditioning removes liquid from the developed toner image, thereby decreasing the toner particle mobility and ability of the toner layer to mix with subsequently deposited toner layers FIG. 9 shows a second embodiment of a printing apparatus in accordance with the invention. In this embodiment, an electrostatic charge pattern is formed on the photoreceptor 23 by a first electrostatic charge pattern generator 24-1. Then, toner is applied to the photoreceptor 23 by two toner applicators 21-5 and 21-6. The developed toner image is then transferred to an image bearing member 28, such as a belt, or other surface as desired. Optionally, an additional electrostatic charge pattern is formed and/or the electrostatic charge pattern is enhanced by a second electrostatic charge pattern generator 24-2 after a toner layer is applied to the photoreceptor 23 by the toner applicator 21-5.

FIGS. 10–14 are used to describe one example of how a toner image can be generated using the FIG. 9 apparatus. FIG. 10 shows the photoreceptor 23 having a first electrostatic latent image formed on it. FIG. 11 shows the photoreceptor 23 after the electrostatic latent image has been developed by the toner applicator 21-5. In this example, CAD is used to develop the image, but discharged area development (DAD) could be used, if desired. In addition, positive polarity toner is used in this example, but negative polarity toner could be used by the toner applicator 21-5. In FIG. 12, the photoreceptor 23 is optionally recharged. In FIG. 13, a second electrostatic latent image is formed on the photoreceptor 23 by the electrostatic charge pattern generator 24-2. The second electrostatic latent image can be the same as or different from the first electrostatic latent image, as desired. In FIG. 14, the second electrostatic latent image is developed by the toner applicator 21-6 using negative polarity toner. Accordingly, in this example, CAD is used to develop the first latent image and DAD is used to develop the second latent image. However, DAD could be used to develop the first latent image and CAD used to develop the second latent image. In addition, this example uses a negative charging photoreceptor 23, but a positive charging photoreceptor 23 can be used.

As will be appreciated by those of skill in the art, the FIG. 9 apparatus could be modified to include only one electrostatic charge pattern generator 24 that can produce a latent image of more than two levels. For example, a trilevel latent image with areas of three distinct charge/voltage levels (fully charged, partially discharged, and fully discharged) can be used. Toner of one polarity can be used to develop the fully charged area while the toner of the opposite polarity will be developed in the fully discharged area through development stations 21-5 and 21-6 with different biases applied, respectively. The area with the intermediate voltage will be the background area.

As will be appreciated by those of skill in the art, the FIG. 9 apparatus could also be modified to include only one electrostatic charge pattern generator 24 and one toner applicator 21. In this case, the toner applicator 21 simultaneously applies toner of opposite polarities to develop an electrostatic latent image on the photoreceptor 23. For example, the toner applicator 21 could use a liquid developing medium that contains both positive and negative polarity toner. Optionally, the toner could be agitated with an AC electric field or other electric, mechanical or other force applied to the medium to keep the toner well suspended. Thus, an electrostatic latent image could be simultaneously developed using both CAD and DAD techniques at the same time.

Figure 15:
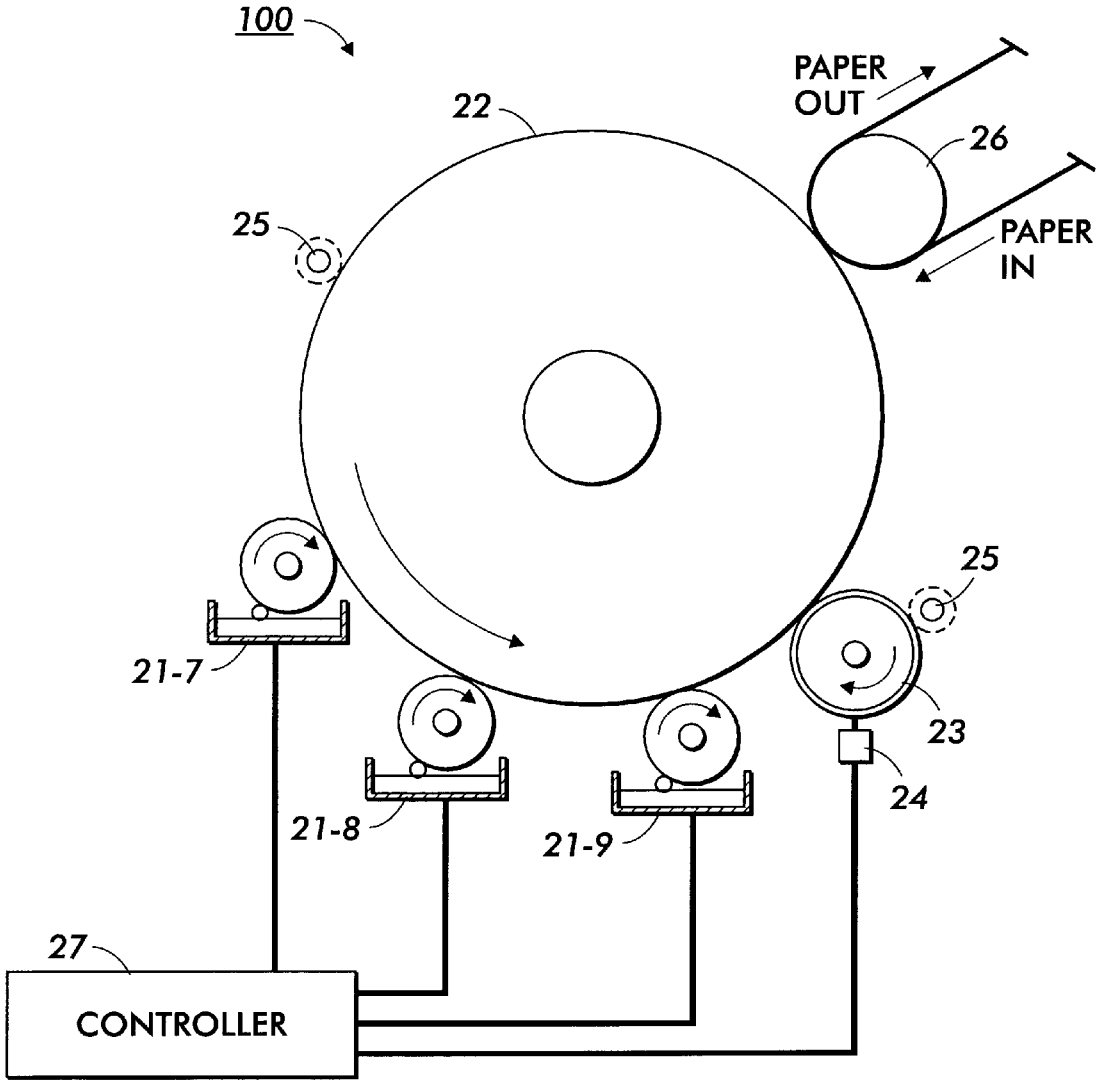
FIG. 15 is a third embodiment of a printing apparatus in accordance with the invention.

FIG. 15 is a schematic block diagram of a third embodiment of a printing apparatus in accordance with the invention. In this embodiment, the toner applicators 21-7, 21-8 and 21-9 are controlled by a controller 27 to deposit patches of toner on the image roll 22 in varying sizes, shapes, densities and locations using a CEP process as described in U.S. Pat. No. 6,009,294. Although three toner applicators 21 are used in this example embodiment, fewer or more than three toner applicators 21 can be used. At least two of the toner applicators 21 apply toner of different polarities to the image roll 22. When using a CEP process, toner layers can also overlap, if desired. Accordingly, a single electrostatic latent image can be formed on the photoreceptor 23 by the electrostatic charge pattern generator 24 and used to operate on the toner layers on the photoreceptor 23 to generate a final toner image. The electrostatic charge pattern on the photoreceptor 23 operates on the toner layers by selectively removing portions of the toner on the image roll 22. Other toner portions left on the image roll 22 represent a developed toner image that is preferably transferred to a final surface, such as a paper substrate, by a transfixing device 26. The transfixing device 26 transfers the toner image on the image roll 22 to the final surface using any one of known techniques, including pressure, heat and/or an electrical charge differential. Of course, the desired toner image that is transferred by the transfixing device 26 to a paper substrate, for example, could be formed on and transferred from the photoreceptor 23 rather than the image roll 22. In this case, the image roll 22 serves only as a toner layer carrier. In either case, residual toner left on the image roll 22 or the photoreceptor 23 is removed by a cleaning devices 25. The cleaning devices 25 can include a scraping blade and/or a sponge roller and/or lamp and/or other known devices for removing residual toner and any remaining electrical charge on the image roll 22 and/or the photoreceptor 23.

Figure 16:
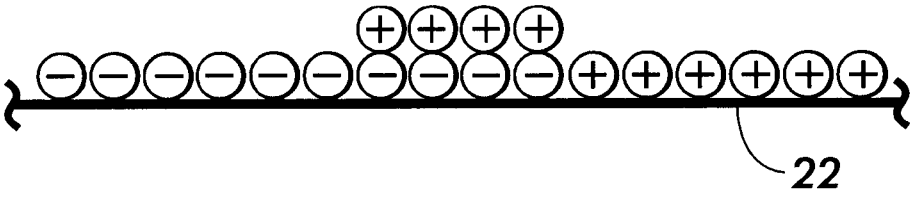
FIGS. 16 and 17 show two stages of an example image generation operation performed by the FIG. 15 printing apparatus.
Figure 17:
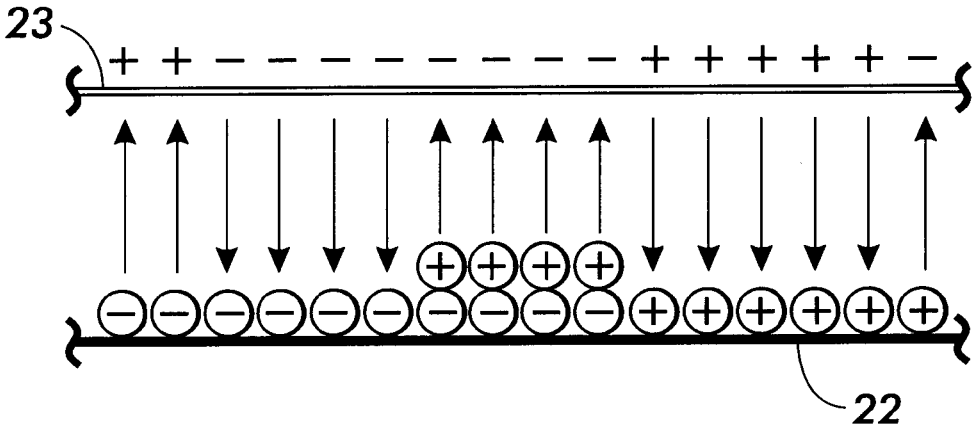

FIGS. 16 and 17 are used to describe one example how the FIG. 15 apparatus 100 is used to form a toner image. FIG. 16 shows a portion of the image roll 22 having two toner layers formed on it. One toner layer of positive polarity toner overlaps a layer of negative polarity toner. In FIG. 17, an electrostatic latent image on the photoreceptor 23 acts on the toner to selectively remove toner from the image roll 22 to form a final toner image. Negatively charged portions of the latent image attract positive toner and repel negative toner. Positively charged portions of the latent image attract negative toner and repel positive toner. Thus, the FIG. 15 apparatus can accurately perform an INI process using opposite polarity toner, although in some cases, the accuracy of the resulting toner image depends on the accuracy of the addressable toner applicators 21.

While the invention has been described with the specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An image forming apparatus comprising:

an image support;

a first toner applicator that deposits first toner having a first polarity on the image support;

a second toner applicator that deposits second toner having an opposite polarity on the image support; and a charge pattern generator that generates an electrostatic charge pattern on a photoreceptor separate from the image support that is used to operate on at least one of the first and second toner to create a toner image, that includes first and second toner, on the image support.

2. The apparatus of claim 1, further comprising two photoreceptors, wherein toner that is applied to the image support by each toner applicator is operated on by an electrostatic charge pattern on a respective photoreceptor.

3. The apparatus of claim 1, wherein the toner applicators are controllable to selectively deposit the toner in patches of one of varying sizes, shapes and locations on the image support.

4. The apparatus of claim 3, further comprising a photoreceptor that carries an electrostatic charge pattern that operates on the toner patches on the support.

5. The apparatus of claim 1, wherein the first toner develops image areas of the electrostatic charge pattern and the second toner develops background areas of the electrostatic charge pattern.

6. The apparatus of claim 1, wherein the charge pattern generator generates a multilevel electrostatic charge pattern.

7. The apparatus of claim 1, further comprising image conditioning means for performing image conditioning between toner applications.

8. An image forming apparatus using a contact electrostatic printing process, comprising:

an image support;

a first toner applicator that deposits first toner having a first polarity on a support, the first toner having a solid concentration of approximately 10–50%;

a second toner applicator that deposits second toner having an opposite polarity on a support, the second toner having a solid concentration of approximately 10–50%; and a charge pattern generator that generates an electrostatic charge pattern that is used to operate on at least one of the first and second toner to create a toner image, that includes first and second toner, on the image support.

9. The apparatus of claim 8, further comprising two photoreceptors, wherein toner that is applied to the image support by each toner applicator is operated on by an electrostatic charge pattern on a respective photoreceptor.

10. The apparatus of claim 8, further comprising a photoreceptor, wherein the electrostatic charge pattern is generated on the photoreceptor before at least one toner applicator applies toner to the photoreceptor.

11. The apparatus of claim 10, wherein the first toner applicator develops image areas of the electrostatic charge pattern and the second toner applicator develops background areas of the electrostatic charge pattern.

12. The apparatus of claim 8, wherein the charge pattern generator generates a multilevel electrostatic charge pattern.

13. The apparatus of claim 8, wherein the toner applicators are controllable to selectively deposit the toner in patches of one of varying sizes, shapes and locations on a support.

14. The apparatus of claim 13, further comprising a photoreceptor that carries an electrostatic charge pattern that operates on the toner patches on the support.

15. The apparatus of claim 8, wherein the toner applicators deposit toner on the image support.

16. The apparatus of claim 8, further comprising image conditioning means for performing image conditioning between toner applications.

17. A method of generating a toner image, comprising:

depositing a first toner having a first polarity and having a solid concentration of approximately 10–50% on a support;

depositing a second toner having an opposite polarity and having a solid concentration of approximately 10–50% on a support; and generating an electrostatic charge pattern that is used to operate on at least one of the first and second toner to create a toner image, that includes first and second toner, on an image support.

18. The method of claim 17, wherein the step of generating an electrostatic charge pattern comprises:

generating a first electrostatic charge pattern on a first photoreceptor;

acting on the first toner on the image support using the first electrostatic charge pattern;

generating a second electrostatic charge pattern on a second photoreceptor; and acting on the second toner on the image support using the second electrostatic charge pattern.

19. The method of claim 17, wherein the step of generating an electrostatic charge pattern comprises:

generating an electrostatic charge pattern on the image support, wherein the first and second toner are deposited on the image support.

20. The method of claim 17, wherein the step of generating an electrostatic charge pattern comprises:

generating an electrostatic charge pattern on a photoreceptor that is used to act on the first and second toner on the image support.

21. The method of claim 20, further comprising:

developing the electrostatic charge pattern such that the first toner develops image areas of the electrostatic charge pattern and the second toner develops background areas of the electrostatic charge pattern.

22. The method of claim 20, wherein the step of generating an electrostatic charge pattern comprises:

generating a multilevel electrostatic charge pattern.

23. The method of claim 17, wherein the steps of depositing the first and second toner comprise controlling toner applicators to selectively deposit toner in patches of one of varying sizes, shapes, density and locations on a support.

24. A printing apparatus comprising:

first toner applicator means for depositing a first toner having a first polarity and having a solid concentration of approximately 10–50% on a support;

second toner applicator means depositing a second toner having an opposite polarity and having a solid concentration of approximately 10–50% on a support; and electrostatic charge pattern generating means for generating an electrostatic charge pattern that is used to operate on at least one of the first and second toner to create a toner image, that includes first and second toner, on an image support.

* * * * *